US009229423B2

(12) United States Patent
Iikura

(10) Patent No.: US 9,229,423 B2
(45) Date of Patent: Jan. 5, 2016

(54) IMAGE FORMING APPARATUS EQUIPPED WITH TONER CONTAINER

(71) Applicant: CANON KABUSHIKI KAISHA, Tokyo (JP)

(72) Inventor: Takayuki Iikura, Kashiwa (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/477,393

(22) Filed: Sep. 4, 2014

(65) Prior Publication Data

US 2015/0071659 A1 Mar. 12, 2015

(30) Foreign Application Priority Data

Sep. 6, 2013 (JP) ..... 2013-184639

(51) Int. Cl.
*G03G 15/08* (2006.01)
*G03G 21/16* (2006.01)
*G03G 15/00* (2006.01)

(52) U.S. Cl.
CPC ..... *G03G 21/1676* (2013.01); *G03G 15/0865* (2013.01); *G03G 15/556* (2013.01)

(58) Field of Classification Search
CPC ..... G03G 15/556; G03G 15/0865; G03G 15/0868; G03G 15/087; G03G 15/0872; G03G 15/0867; G03G 21/1676
See application file for complete search history.

(56) References Cited

U.S. PATENT DOCUMENTS 5,296,900 A * 3/1994 Saijo et al. ..... 399/260
6,097,903 A * 8/2000 Yahata et al. ..... 399/27
6,118,951 A * 9/2000 Kato et al. ..... 399/27
6,240,262 B1 * 5/2001 Taniyama et al. ..... 399/12
6,256,469 B1 * 7/2001 Taniyama et al. ..... 399/258
6,289,182 B1 * 9/2001 Umezawa et al. ..... 399/12
6,587,648 B1 * 7/2003 Taniyama ..... 399/12
7,003,233 B2 * 2/2006 Matsuda et al. ..... 399/27
2003/0133722 A1 * 7/2003 Kaiho ..... 399/27
2003/0219262 A1 * 11/2003 Doi ..... 399/12
2007/0003296 A1 * 1/2007 Miyata ..... 399/27
2008/0013989 A1 * 1/2008 Takuwa ..... 399/262
2008/0044204 A1 * 2/2008 Inoue ..... 399/262
2009/0269088 A1 * 10/2009 Mizuta ..... 399/30
2011/0243579 A1 * 10/2011 Oshikawa et al. ..... 399/12
2012/0014713 A1 1/2012 Murakami et al.
2013/0170846 A1 * 7/2013 Kosasa ..... 399/12
2013/0202275 A1 * 8/2013 Brown et al. ..... 388/809
2014/0044442 A1 * 2/2014 Taniguchi ..... 399/27
2015/0037051 A1 * 2/2015 Iikura et al. ..... 399/13
2015/0037072 A1 * 2/2015 Iikura et al. ..... 399/258

* cited by examiner

*Primary Examiner* — David Bolduc
(74) *Attorney, Agent, or Firm* — Rossi, Kimms & McDowell LLP

(57) ABSTRACT

An image forming apparatus detecting container's dismounting. A drive unit rotates the container for replenishing toner to a development unit. An output unit outputs a first signal while a predetermined portion of the container is detected, and outputs a second signal while the predetermined portion is not detected. A decision unit decides a count of changes from the second signal to the first signal based on a toner replenishing amount. A detection unit detects dismounting of the container in a case where the first signal is changed to the second signal during not rotating. The controller stops the rotation in a case where the count of changes reaches the count decided, controls the drive unit to output the first signal in a case where containers should be exchanged, and does not control the drive unit to output the first signal in a case where containers should not be exchanged.

17 Claims, 12 Drawing Sheets

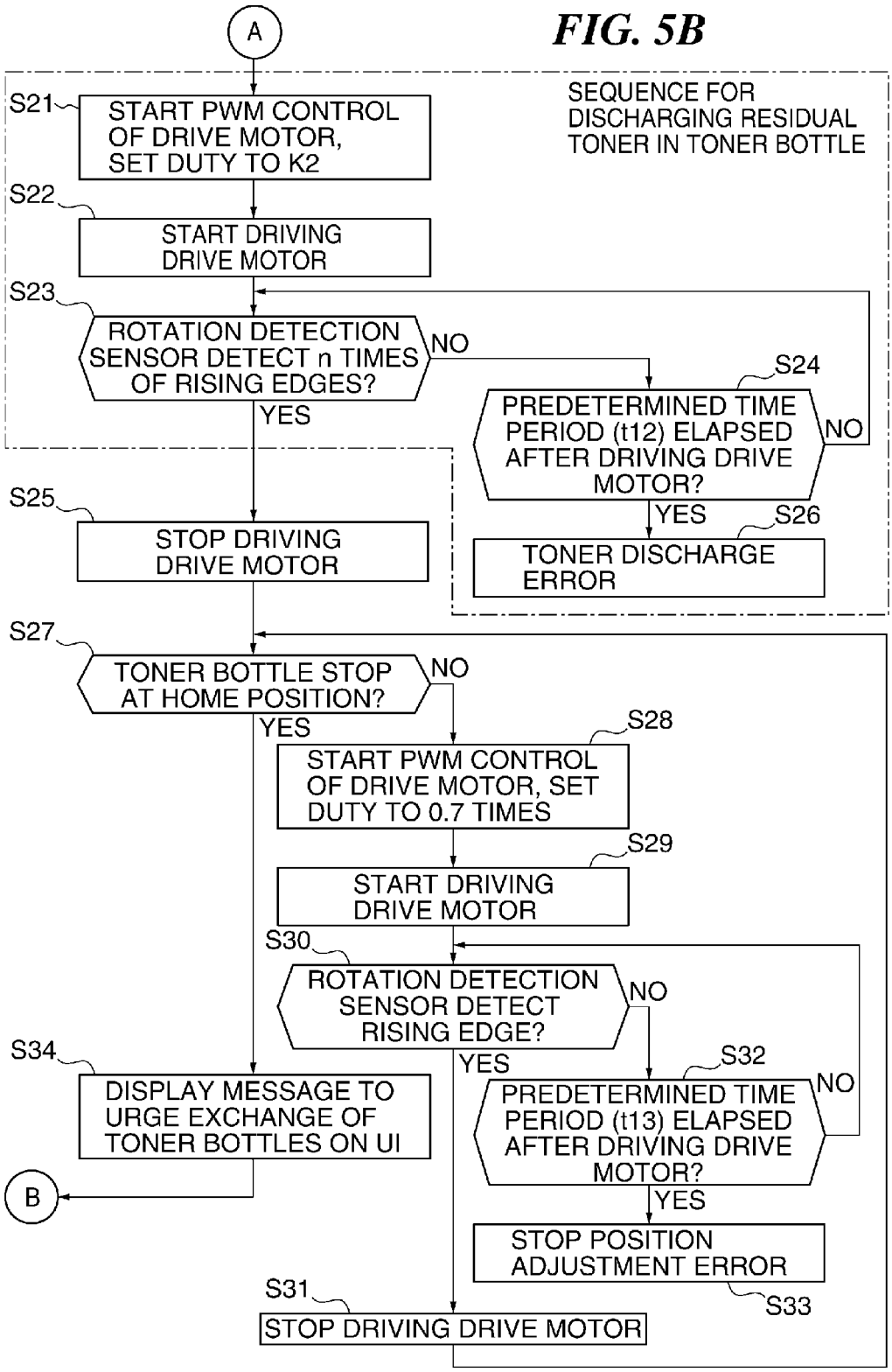
FIG. 5B
A
SEQUENCE FOR DISCHARGING RESIDUAL TONER IN TONER BOTTLE
S21
START PWM CONTROL OF DRIVE MOTOR, SET DUTY TO K2
S22
START DRIVING DRIVE MOTOR
S23
ROTATION DETECTION SENSOR DETECT n TIMES OF RISING EDGES?
NO
YES
S24
PREDETERMINED TIME PERIOD (t12) ELAPSED AFTER DRIVING DRIVE MOTOR?
NO
YES
S26
TONER DISCHARGE ERROR
S25
STOP DRIVING DRIVE MOTOR
S27
TONER BOTTLE STOP AT HOME POSITION?
NO
YES
S28
START PWM CONTROL OF DRIVE MOTOR, SET DUTY TO 0.7 TIMES
S29
START DRIVING DRIVE MOTOR
S30
ROTATION DETECTION SENSOR DETECT RISING EDGE?
NO
YES
S32
PREDETERMINED TIME PERIOD (t13) ELAPSED AFTER DRIVING DRIVE MOTOR?
NO
YES
S34
DISPLAY MESSAGE TO URGE EXCHANGE OF TONER BOTTLES ON UI
B
STOP POSITION ADJUSTMENT ERROR
S33
S31
STOP DRIVING DRIVE MOTOR

IMAGE FORMING APPARATUS EQUIPPED WITH TONER CONTAINER

BACKGROUND OF THE INVENTION

1. Field of the Invention

The present invention relates to an image forming apparatus equipped with a container in which toner is contained.

2. Description of the Related Art

An image forming apparatus of an electrophotographic system forms a toner image by developing an electrostatic latent image formed on a photosensitive member using developer (referred to as toner, hereafter) in a development device. Since the amount of toner that can be accumulated in the development device is limited, the toner is replenished to the development device from a container that is detachable to the main body of the image forming apparatus.

For example, there is proposed a container that is provided with a rotation portion that is rotated, a pump portion for changing internal pressure of a chamber to discharge toner from the chamber that accommodates the toner, and a converter that converts a rotating motion of the rotation portion into a reciprocating motion of the pump portion (see US 20120014713A1). This container discharges the toner in a chamber by making the pump portion expand and contract according to the rotation of the container. That is, the air that is sucked from a discharging port as the pump portion expands loosens the toner in the chamber, and then, the chamber becomes in a positive pressure state and the air in the chamber forces out the toner, which covers the discharging port, from the discharging port as the pump portion contracts.

Incidentally, if an image forming apparatus is provided with a dedicated detection means to detect mounting/dismounting of a container in order to determine whether the container is dismounted from the image forming apparatus, there is a problem that the cost of an image forming apparatus will increase.

SUMMARY OF THE INVENTION

The present invention provides an image forming apparatus that is capable of detecting whether a container is dismounted with high accuracy without adding a dedicated detection means.

Accordingly, a first aspect of the present invention provides an image forming apparatus comprising a development unit configured to develop an electrostatic latent image formed on a photosensitive member using toner, a mounting portion configured to which a container is mountable, the container containing toner, a drive unit configured to rotate the container mounted to the mounting portion for replenishing the toner in the container to the development unit, an output unit configured to detect a predetermined portion of the container in a rotation direction of the container that is rotated by the drive unit, to output a first signal while the predetermined portion is detected, and to output a second signal while the predetermined portion is not detected, a decision unit configured to decide a toner replenishing amount that should be replenished to the development unit, and to decide a count of changes of the output of the output unit from the second signal to the first signal while the drive unit rotates the mounted container based on the decided replenishing amount, a controller configured to control the drive unit based on the count decided by the decision unit, a determination unit configured to determine whether the container mounted to the mounting portion should be exchanged with a new container, and a detection unit configured to detect that the container mounted to the mounting portion is dismounted in a case where the output of the output unit changes from the first signal to the second signal in a period during which the mounted container is not rotating. The controller is configured to control the drive unit to stop the rotation of the container in a case where the count of changes of the output of the output unit from the second signal to the first signal reaches the count decided by the decision unit. The controller controls, in a case where the determination unit determines that the mounted container should be exchanged with a new container, the drive unit so that the output unit outputs the first signal when the output unit outputs the second signal at the time of stopping the rotation of the container by the drive unit. The controller does not control, in a case where the determination unit does not determine that the mounted container should be exchanged with a new container, the drive unit so that the output unit outputs the first signal even when the output unit outputs the second signal at the time of stopping the rotation of the container by the drive unit.

According to the present invention, it is able to detect whether a container is removed with high accuracy without adding a dedicated detection means.

Further features of the present invention will become apparent from the following description of exemplary embodiments with reference to the attached drawings.

BRIEF DESCRIPTION OF THE DRAWINGS

FIG. 5A and FIG. 5B are flowcharts showing a toner-bottle stop process according to the first embodiment of the present invention.

DESCRIPTION OF THE EMBODIMENTS

Hereafter, embodiments according to the present invention will be described in detail with reference to the drawings.

Figure 1:
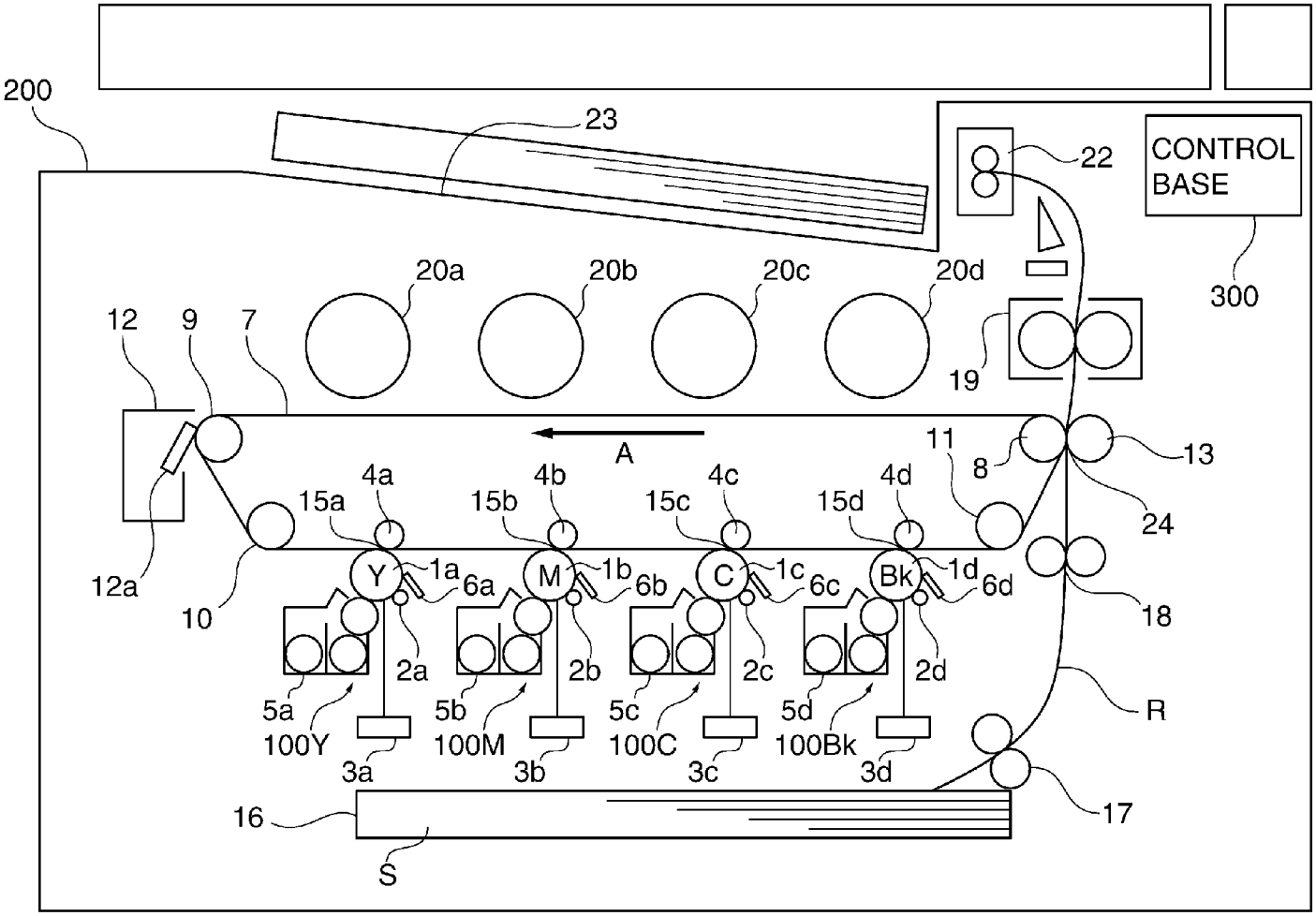
FIG. 1 is a sectional view schematically showing a configuration of an image forming apparatus according to an embodiment of the present invention.

FIG. 1 is a sectional view schematically showing a configuration of an image forming apparatus according to a first embodiment of the present invention.

As shown in FIG. 1, the image forming apparatus 200 is a color image forming apparatus that employs an electrophotographic system, and is an image forming apparatus of an intermediate transfer tandem system in which image forming units 100Y, 100M, 100C, and 100Bk corresponding to four colors are arranged side by side in an approximately horizontal direction, for example.

The image forming units 100Y, 100M, 100C, and 100Bk are provided with photosensitive drums 1*a*, 1*b*, 1*c*, and 1*d*, charging devices 2*a*, 2*b*, 2*c*, and 2*d*, exposure devices 3*a*, 3*b*, 3*c*, and 3*d*, development devices 5*a*, 5*b*, 5*c*, and 5*d*, and primary transfer rollers 4*a*, 4*b*, 4*c*, and 4*d*, respectively. Here, the photosensitive drums 1*a*, 1*b*, 1*c*, and 1*d* function as photosensitive members. Moreover, the image forming units 100Y, 100M, 100C, and 100Bk are provided with drum cleaners 6*a*, 6*b*, 6*c*, and 6*d*, respectively.

An intermediate transfer belt 7 is arranged above the image forming units. The intermediate transfer belt 7 is an endless belt, and rotates in a direction of an arrow A in FIG. 1. The intermediate transfer belt 7 is looped over a driving roller 8 (a secondary transfer internal roller 8) that drives the intermediate transfer belt 7 concerned, a tension roller 9, a roller 10, and a roller 11 so as to be rotatable. Toner bottles 20*a*, 20*b*, 20*c*, and 20*d* as containers that replenish toner as developer to the development devices 5*a*, 5*b*, 5*c*, and 5*d* of the image forming units, respectively, are arranged above the intermediate transfer belt 7.

A sheet cassette 16 is arranged under the image forming units 100Y through 100Bk. The sheet cassette 16 stores a sheet S as a recording medium. The image forming apparatus 200 is provided with a conveyance path R along which the sheet S is conveyed from the sheet cassette 16 to an ejecting roller pair 22 through a fixing device 19. A feed roller pair 17 and a registration roller pair 18 are arranged along the conveyance path. The fixing device 19 is provided with a heater used as a heat source.

Next, an operation of each unit of the image forming apparatus 200 in a case where the image forming apparatus 200 forms an image on a sheet S will be described. After the photosensitive drums 1*a* through 1*d* of the image forming units 100Y through 100Bk start rotation, the charging devices 2*a* through 2*d* uniformly charge the surfaces of the photosensitive drums 1*a* through 1*d*. Next, in order to form electrostatic latent images on the photosensitive drums 1*a* through 1*d*, the exposure devices 3*a* through 3*d* irradiate the photosensitive drums 1*a* through 1*d* with laser beams modulated according to image signals. Accordingly, electrostatic latent images are formed on the photosensitive drums 1*a* through 1*d*. The development devices 5*a* through 5*d* develop the electrostatic latent images formed on the photosensitive drums 1*a* through 1*d* using toner. The electrostatic latent images on the photosensitive drums 1*a* through 1*d* appear as toner images. When primary transfer biases are given to the toner images formed on the photosensitive drums 1*a* through 1*d* in primary transfer areas 15*a* through 15*d*, the toner images are transferred to the intermediate transfer belt 7. In a case where the toner images formed by the image forming units 100Y through 100Bk are transferred to the intermediate transfer belt 7 in piles, a full color image is formed on the intermediate transfer belt 7. The primary transfer areas 15*a*, 15*b*, 15*c*, and 15*d* are formed between the photosensitive drums 1*a*, 1*b*, 1*c*, and 1*d* and the primary transfer rollers 4*a*, 4*b*, 4*c*, and 4*d* of the respective image forming units.

The toner that is remained on the photosensitive drums 1*a* through 1*d* without being transferred to the intermediate transfer belt 7 is removed from the photosensitive drums 1*a* through 1*d* by the drum cleaners 6*a* through 6*d*. Moreover, when the toner amounts in the development devices 5*a* through 5*d* drop, the toner is replenished from the toner bottles 20*a* through 20*d*. The concrete toner replenishment method will be mentioned later.

The sheet S is conveyed to the secondary transfer section 24 in response to the timing at which the color image formed on the intermediate transfer belt 7 is conveyed to the secondary transfer area 24. The secondary transfer area 24 is formed on the intermediate transfer belt 7 between the secondary transfer internal roller 8 and a secondary transfer external roller 13. The sheet S sent out by the feed roller pair 17 is conveyed towards the registration roller pair 18 through the conveyance path R. The registration roller pair 18 corrects the skew of the sheet S, and conveys the sheet S to the secondary transfer area 24 after adjusting the timing at which the sheet S is conveyed to the secondary transfer area 24. When the sheet S passes the secondary transfer area 24, a secondary transfer bias is given to the secondary transfer internal roller 8 and the secondary transfer external roller 13. This transfers the image on the intermediate transfer belt 7 to the sheet S. The toner that remained on the intermediate transfer belt 7 without being transferred to the sheet S is removed from the intermediate transfer belt 7 with a blade 12*a* of a belt cleaner 12.

The sheet S to which the color image was transferred is carried in to the fixing device 19. The fixing device 19 is provided with two rollers that face to each other, and a fixing nip position is formed between the two rollers concerned. Furthermore, the fixing device 19 has a heater. While the sheet S passes the fixing nip position, the rollers put pressure on the sheet S, and the heater gives heat to the sheet S. As a result of this, the toner that constitutes the color image on the sheet S melts, and the color image is fixed to the sheet S. The sheet S to which the color image has been fixed is ejected to a sheet ejection tray 23 through the ejection roller pair 22.

Next, the developer replenishment mechanism (referred to as a "toner replenishment mechanism", hereafter) in the image forming apparatus 200 in FIG. 1 will be described. The toner replenishment mechanism supplies the toner as developer to each of the development devices 5*a* through 5*d*. There are four toner replenishment mechanisms corresponding to the image forming units 100Y through 100Bk, respectively. They are the same configurations altogether. Accordingly, the configuration, operation, etc. of the toner replenishment mechanism corresponding to the image forming unit 100Y will be described in detail as an example.

The toner replenishment mechanism is provided with a bottle mounting portion that is built in the image forming apparatus 200, the toner bottle that is mounted on the bottle mounting portion, and a drive motor as a rotating driving source therefor.

Figure 2A:
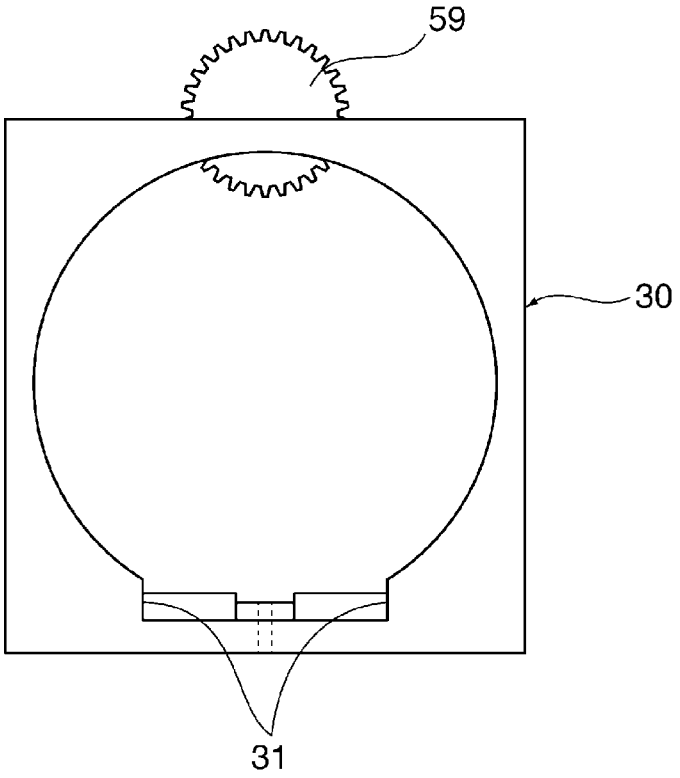
FIG. 2A is a front view showing a main part of a bottle mounting portion included in the image forming apparatus shown in FIG. 1.
Figure 2B:
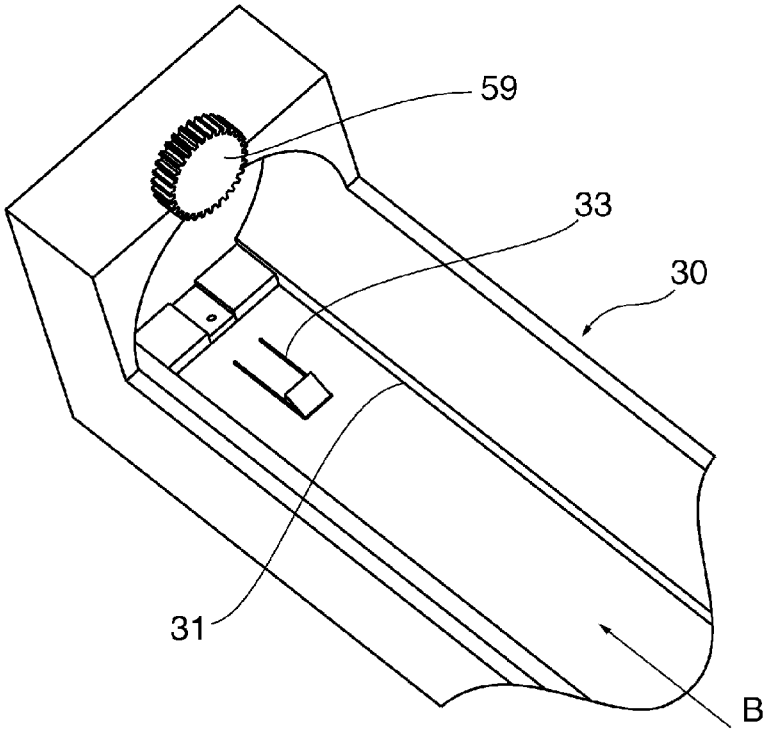
FIG. 2B is a perspective view showing the bottle mounting portion of which a part is cut out, in the image forming apparatus shown in FIG. 1.

FIG. 2A is a front view showing a main part of the bottle mounting portion included in the image forming apparatus 200 shown in FIG. 1. FIG. 2B is a perspective view showing the bottle mounting portion of which a part is cut out.

As shown in FIG. 2A and FIG. 2B, the bottle mounting portion has a mounting portion body 30 and a drive gear 59 that is provided on the mounting portion body 30. A semi-cylindrical concave portion into which the approximately cylindrical toner bottle is fit, and a through hole of generally circular shape in cross section into which an edge of the toner bottle is fit are formed in the mounting portion body 30. When the toner bottle that contains the toner is mounted by sliding along an arrow B, the drive gear 59 is meshed with a driven gear of the toner bottle, and transmits driving force to the toner bottle. A rotation regulating portion 31 of a step shape that regulates the rotation of a cap (mentioned below) of the toner bottle by engaging with a projection part of the cap is formed on the semi-cylindrical concave portion of the mounting portion body 30 in the longitudinal direction thereof. A slide lock 33 is provided in the bottom of one end of the semi-cylindrical concave portion. The slide lock 33 regulates movement of the toner bottle in a direction of a rotating axis thereof.

Figure 3A:
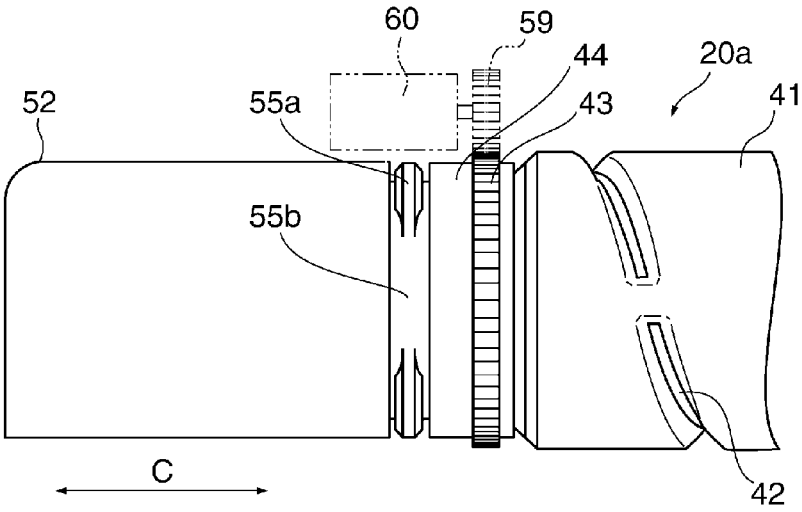
FIG. 3A is an external view of a toner bottle that is mounted to the bottle mounting portion shown in FIG. 2A.
Figure 3B:
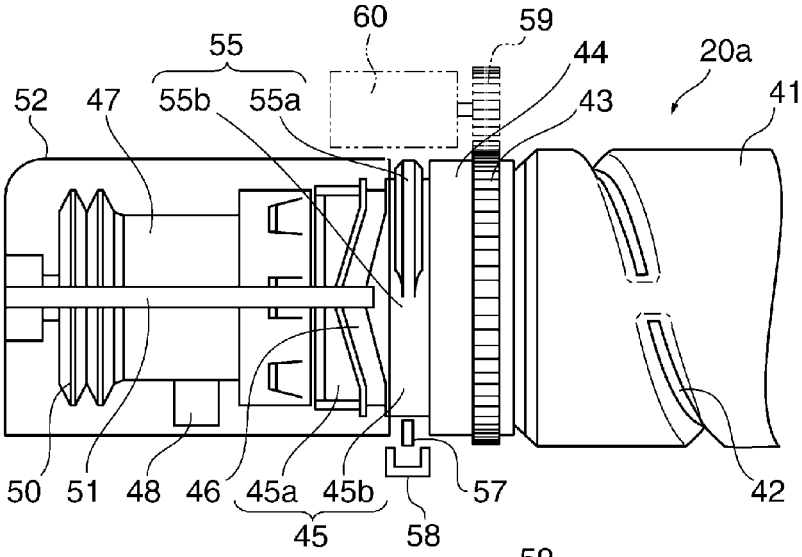
FIG. 3B is a view showing a state where a pump unit of the toner bottle that is mounted to the bottle mounting portion shown in FIG. 2A expands to the maximum.

FIG. 3A is an external view of the toner bottle that is mounted to the bottle mounting portion shown in FIG. 2A. FIG. 3B is a view showing a state where a pump unit of the toner bottle expands to the maximum. Moreover, FIG. 3C is a view showing a state where the pump unit of the toner bottle contracts to the minimum.

Figure 3C:
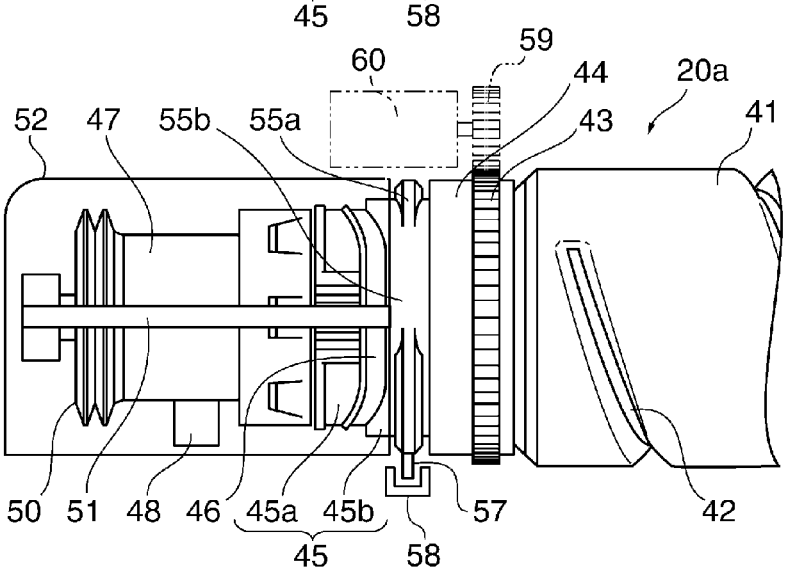
FIG. 3C is a view showing a state where the pump unit of the toner bottle that is mounted to the bottle mounting portion shown in FIG. 2A contracts to the minimum.

As shown in FIG. 3A through FIG. 3C, the toner bottle 20*a* discharges toner toward the development device in synchronization with a rotary action. The toner bottle 20*a* has a chamber 41 that contains toner, a driving force receiving section 44 into which rotational driving force is inputted, a drum section 45 connected with the driving force receiving section 44, a discharging section 47 that discharges toner, and the pump unit 50 that controls pressure in the discharging section 47. A driven gear 43 is formed around the driving force receiving section 44 in the circumferential direction. The driven gear 43 meshes with the drive gear 59 of a toner-bottle drive motor (referred to as a "drive motor", hereafter) 60 that drives the toner bottle 20*a*. Rotational driving force is inputted into the driving force receiving section 44 from the drive motor 60 through the drive gear 59 and the driven gear 43.

Conveyance ridges 42 projected spirally are formed on an inner peripheral side of the chamber 41. Accordingly, the toner in the chamber 41 is conveyed to the discharging section 47 as the chamber 41 rotates.

The drum section 45 consists of a small diameter portion 45*a* and a large diameter portion 45*b*. A detected portion 55, which consists of convex parts 55*a* and flat parts 55*b*, is provided on the large diameter portion 45*b* of the drum section 45 around its circumference. A rotation detection sensor 58 is arranged so as to face the detected portion 55. A rotation detection flag 57 is arranged so as to contact with the detected portion 55. When contacting with the convex part 55*a* (a predetermined portion), the rotation detection flag 57 is moved to the rotation detection sensor 58 and is detected with the rotation detection sensor 58. When contacting with the flat part 55*b*, the rotation detection flag 57 retreats from the rotation detection sensor 58 and is not detected with the rotation detection sensor 58. The two convex parts 55*a* and the two flat parts 55*b* are provided alternately, and the rotation detection sensor 58 repeats the change to the OFF state from the ON state and the change to ON state from the OFF state twice during one rotation of the toner bottle 20*a*. The rotation detection sensor 58 functions as an output unit that outputs a specified signal according to the rotation state of the toner bottle 20*a*.

Moreover, a cam groove 46 that curves in a specific pattern is formed for the whole circumference of the small diameter portion 45*a* of the drum section 45 in the circumferential direction. The toner discharging portion 47 that interconnects with the chamber 41, and the pump unit 50 that connects to the chamber 41 are provided at the opposite side of the chamber 41 with respect to the drum section 45. A discharging port 48 for the toner is provided in the toner discharging portion 47. The diameter of the discharging port 48 is about 2 mm, for example.

The toner discharging portion 47 and the pump unit 50 exhibit approximately cylindrical shapes. The small diameter portion 45*a*, the toner discharging portion 47, and the pump unit 50 are covered with the cap 52. The pump unit 50 is the resin-made pump on which mountain fold parts and valley fold parts are formed alternately, and the reciprocation member 51 is fixed to the tip portion of the pump unit 50. The reciprocation member 51 has hooks (not shown) at the front ends of two arms, and these hooks engage with the cam groove 46.

The reciprocation member 51 and the cam groove 46 with which the reciprocation member 51 is engaged constitute a driving force converting mechanism that converts a part of rotational driving force inputted to the toner bottle 20*a* into linear reciprocation driving force. That is, the drum section 45 rotates with the chamber 41 by means of the rotational driving force inputted to the toner bottle 20*a* from the drive motor 60. When the drum section 45 rotates, the reciprocation member 51 that engages with the cam groove 46 repeats linear motions by reciprocating in a direction of an arrow C. When the reciprocation member 51 reciprocates, the end of the pump unit 50 fixed to its tip portion also reciprocates in the direction of the arrow C. As a result of this, the pump unit 50 repeats expansion (FIG. 3B) and contraction (FIG. 3C), and changes the volume inside the pump unit 50. When the toner bottle 20*a* rotates, the toner in the chamber 41 is conveyed to the toner discharging portion 47 with the conveying ridge 42, and stagnates in the toner discharging portion 47 temporarily. Then, the toner in the toner discharging portion 47 is replenished to the development device from the discharging port 48 in response to the action of the pump unit 50.

The pump unit 50 functions as an air-intake-and-exhaust mechanism that performs an intake operation and an exhaust operation alternately through the discharging port 48. Moreover, since the air intake and exhaust by the pump unit 50 generates an airflow that flows from the discharging port 48 into the toner bottle 20*a* and an airflow that flows from the inside of the toner bottle 20*a* toward the outside of the toner discharging portion 47 through the discharging port 48 alternately, the pump unit 50 functions as an air-flow generation mechanism.

The reciprocation member 51 reciprocates two times in the direction of the arrow C during one rotation of the toner bottle 20*a*, and the pump unit 50 repeats expansion and contraction twice. As a result of this, the toner is intermittently replenished toward the development device (not shown). The toner amount replenished to the development device from the toner bottle 20*a* is calculated based on the pumping count of the pump unit 50 and the rotational velocity of the toner bottle 20*a*. Among these, the pumping count of the pump unit 50 is determined according to the number of rising edges mentioned later.

It should be noted that the outer circumferential surface of the cap 52 has a projection part that is projected outward, and this projection part is fitted to the rotation regulating portion 31 formed on the mounting portion body 30 of the bottle mounting portion to which the toner bottle 20*a* is mounted. Accordingly, the cap 52 of the toner bottle 20*a* does not rotate. Furthermore, since the cap 52 engages with the slide lock 33 that is formed on the mounting portion body 30, the movement in the direction of the arrow C is regulated, and the cap 52 does not reciprocate even when the toner bottle 20*a* rotates. Moreover, the toner discharging portion 47 is connected with the drum section 45 through a slide part, and is regulated by a rotation regulating member (not shown) so as not to rotate. Accordingly, the toner discharging portion 47 and the pump unit 50 do not rotate, even when the drum section 45 rotates.

Next, a control configuration of the toner replenishment system in the image forming apparatus 200 of such a configuration will be described.

Figure 4:
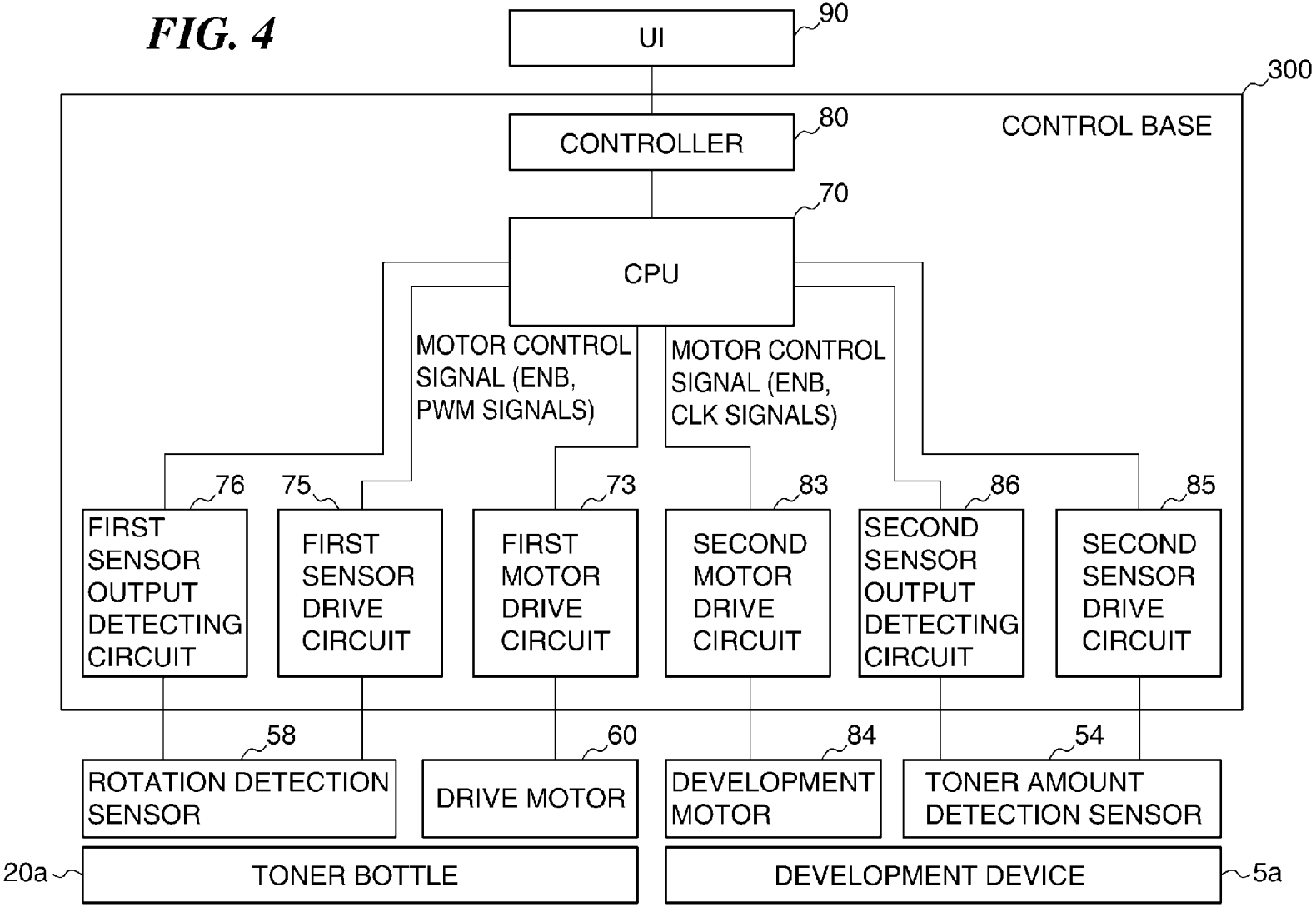
FIG. 4 is a block diagram schematically showing a control system of the image forming apparatus shown in FIG. 1.

FIG. 4 is a block diagram schematically showing a control system of the image forming apparatus shown in FIG. 1.

As shown in FIG. 4, a control base 300 that controls the whole image forming apparatus 200 has a CPU (central processing unit) 70. The CPU 70 is connected with the drive motor 60 that drives the toner bottle 20*a* through a first motor drive circuit 73, and is connected with the rotation detection sensor 58 that detects a rotation of the toner bottle 20*a* through a first sensor drive circuit 75 and a first sensor output detecting circuit 76. Moreover, the CPU 70 is connected with a development motor 84 of the development device 5*a* through a second motor drive circuit 83, and is connected with a toner amount detection sensor 54 of the development device 5*a* through a second sensor drive circuit 85 and a second sensor output detecting circuit 86. Furthermore, the CPU 70 is connected with a controller 80, and is connected with a user interface (UI) 90 through the controller 80.

A motor control signal, which consists of an ENB (ENABLE) signal and a PWM (Pulse Width Modulation) signal, is inputted to the first motor drive circuit 73 from the CPU 70, and the drive motor 60 rotates according to the inputted signal. The ENB signal switches ON/OFF of the drive motor 60, and the PWM signal adjusts electrical energy given to the drive motor 60, i.e., adjusts driving force (rotational velocity) of the drive motor 60. The toner bottle 20*a* is rotated with the drive motor 60, and discharges the toner of specified quantity by one pumping operation (one stroke of the replenishment operation) of the pump unit 50. An output of the rotation detection sensor 58 that is driven by the first sensor drive circuit 75 and is in a detectable state is sent to the CPU 70 through the first sensor output detecting circuit 76.

When the toner bottle 20*a* rotates under a condition where the toner bottle 20*a* is mounted to the image forming apparatus 200, the output of the rotation detection sensor 58 varies from a "Hi" signal as a specified signal (first signal) to a "Low" signal as a signal other than the specified signal (second signal), and varies from the "Low" signal to the "Hi" signal. Thus, the turning point at which the output of the rotation detection sensor 58 varies from the "Low" signal to the "Hi" signal corresponds to the termination point of the toner discharging operation. Accordingly, the CPU 70 presumes the toner amount replenished by monitoring the output of the rotation detection sensor 58 through the first sensor output detecting circuit 76. The operation of the rotation detection sensor 58 will be described in detail later.

The toner amount detection sensor 54 is provided in the development device 5*a*, and the toner amount detection sensor 54 is driven by the second sensor drive circuit 85 and will be in a detectable state. The toner amount detection sensor 54 outputs a signal in response to magnetic permeability that varies based on proportion (toner density) of the toner over the developer contained in the development device 5*a*. In order to maintain density of an output image uniformly, it is preferable to maintain the toner density at a certain value, i.e., it is preferable to maintain the output value of the toner amount detection sensor 54 at a specified target value. The CPU 70 detects the toner density in the development device 5*a* that is detected with the toner amount detection sensor 54 through the second sensor output detecting circuit 86, determines whether the toner should be replenished, and determines whether the toner bottle 20*a* contains no toner. When determining that the toner bottle 20*a* contains no toner, the CPU 70 notifies a user by displaying a message to urge the user to exchange toner bottles on the UI 90 at a specified timing.

In the image forming apparatus 200 of such a configuration, rotational driving force is inputted to the driving force receiving section 44 (FIG. 3A) of the toner bottle 20*a* that is mounted to the bottle mounting portion from the drive motor 60 provided in the main body of the image forming apparatus. The chamber 41 of the toner bottle 20*a* to which the rotational driving force is inputted rotates in a predetermined direction like a clockwise direction. With rotation of the chamber 41, the toner contained in the chamber 41 is conveyed with the spiral conveying ridges 42 formed on the inner wall thereof, and flows into the toner discharging portion 47. On the other hand, the rotational driving force inputted into the driving force receiving section 44 is converted into reciprocation driving force with the driving force converting mechanism, and the pump unit 50 repeats expansion and contraction by the reciprocation driving force. Expansion and contraction of the pump unit 50 are repeated with a specified period synchronizing with the rotary action of the chamber 41. At the time of compression, the toner in the toner discharging portion 47 is discharged through the discharging port 48, and is replenished to the development device 5*a*.

It should be noted that two-ingredient developer that is mixture of non-magnetic toner and magnetic carrier, or one-ingredient developer that is magnetic toner or non-magnetic toner is used as the developer.

Incidentally, this embodiment detects that the toner bottle 20*a* is dismounted from the image forming apparatus 200 and that the toner bottle 20*a* is mounted to the apparatus using the rotation detection sensor 58 that detects the rotation phase of the toner bottle 20*a*. Accordingly, in a case where the toner bottle 20*a* needs to be exchanged with a new bottle, it is necessary to stop the toner bottle 20*a* in a state where the convex part 55*a* that is the specified portion of the detecting element 55 of the toner bottle 20*a* is detected and the rotation detection sensor 58 outputs the "Hi" signal. Hereinafter, the state where the rotation detection sensor 58 outputs the "Hi" signal (the state where the pump unit 50 contracts) is referred to as a detecting state, and the position of the toner bottle in the state is referred to as a home position. On the other hand, the state where the rotation detection sensor 58 outputs the "Low" signal is referred to as a non-detecting state.

Next, a toner-bottle stop process for stopping the toner bottle at the home position using the image forming apparatus 200 will be described.

Figure 5A:
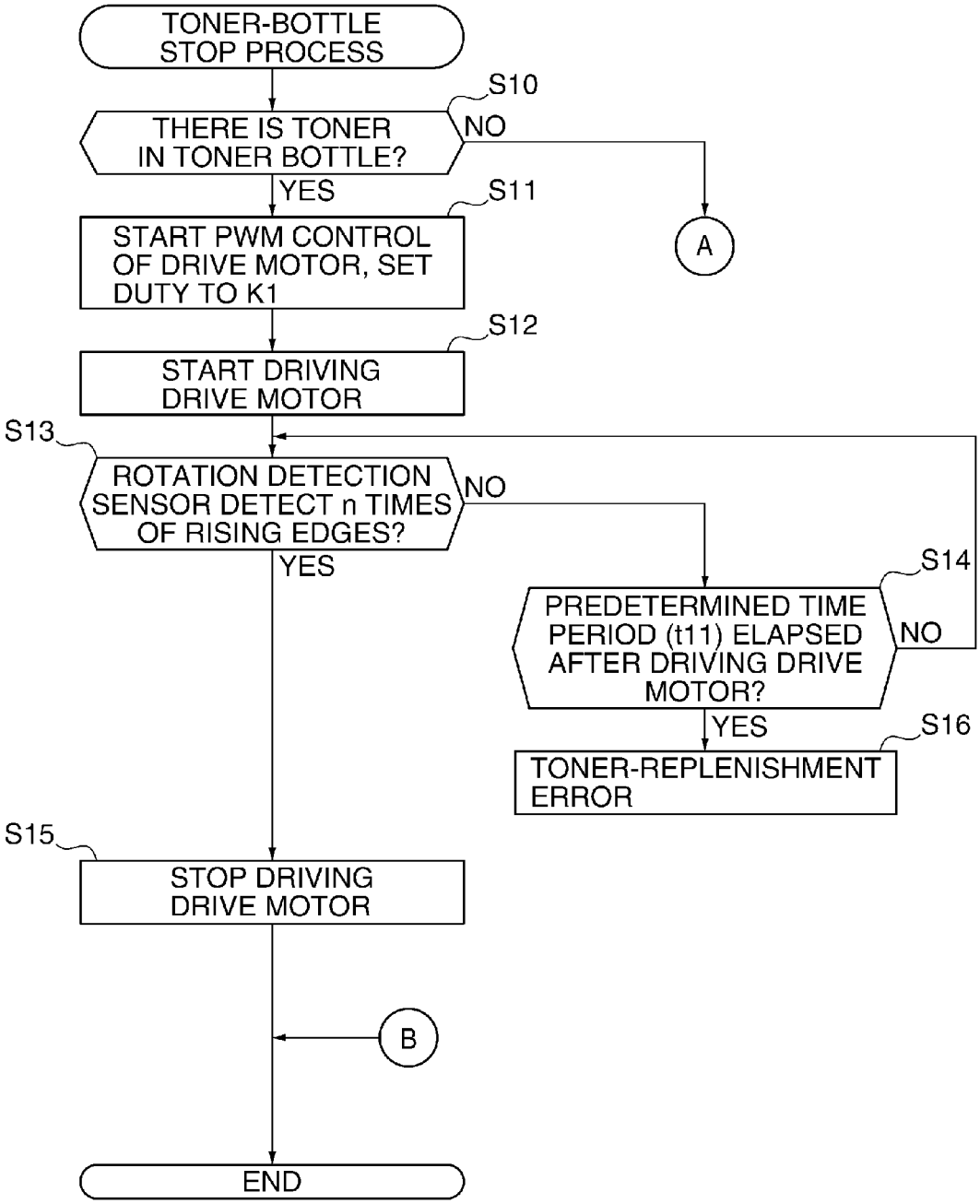

FIG. 5A and FIG. 5B are flowcharts showing the toner-bottle stop process according to the first embodiment. This toner-bottle stop process is executed by the CPU 70 that is arranged on the control base 300 of the image forming apparatus 200 according to a toner-bottle stop process program stored in a ROM (not shown).

As shown in FIG. 5A, when the toner-bottle stop process is started, the CPU 70 determines whether there is sufficient toner in the toner bottle 20*a* that is mounted to the image forming apparatus 200 first (step S10). The CPU 70 determines whether there is toner in the toner bottle 20*a* based on a variation of the output value of the toner amount detection sensor 54 at the time of the last toner replenishment operation. That is, in a case where it is continuously detected that the toner amount in the development device 5*a* is below a specified value without increasing in spite of performing the toner replenishment operation last time, the CPU 70 determines that the toner in the toner bottle 20*a* is empty.

As a result of the determination in the step S10, when it is determined that there is toner in the toner bottle 20*a* ("YES" in the step S10), the CPU 70 executes a regular toner replenishment process. That is, the CPU 70 starts a PWM control of the drive motor 60, and sets a DUTY ratio of a PWM signal to K1 that is defined beforehand (step S11). Here, the DUTY ratio of the PWM signal is a rate of a time period during which electric current is supplied to the drive motor 604 in a minute time period.

Next, the CPU 70 starts driving the drive motor 60 (step S12). When the drive of the drive motor 60 starts, the toner bottle 20*a* rotates, and the detected portion 55 that is formed on the drum section 45 of the toner bottle 20*a* also rotates with the rotation of the toner bottle 20*a*. The convex part 55*a* of the detected portion 55 pushes up the end of the rotation detection flag 57 twice intermittently while the toner bottle 20*a* rotates once. As a result of this, the rotation detection flag 57 is detected by the rotation detection sensor 58.

Figure 6A:
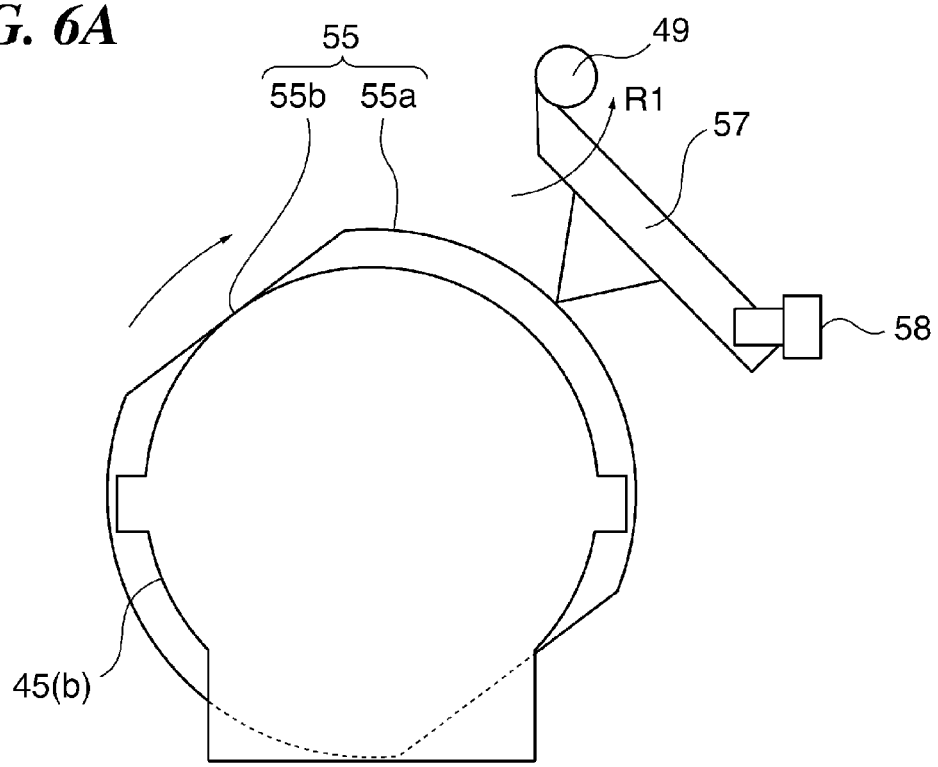
FIG. 6A is a view schematically showing a main part in a state where a rotation detection flag is in contact with a convex portion of a detected portion of the toner bottle as shown in FIG. 3C.

FIG. 6A is a view schematically showing a main part in a state where the rotation detection flag 57 is in contact with the convex portion 55*a* of the detected portion 55 of the toner bottle 20 as shown in FIG. 3C. Moreover, FIG. 6B is a view schematically showing the main part in a state where the rotation detection flag 57 is in contact with the flat portion 55*b* of the detected portion 55 of the toner bottle 20 as shown in FIG. 3B.

Figure 6B:
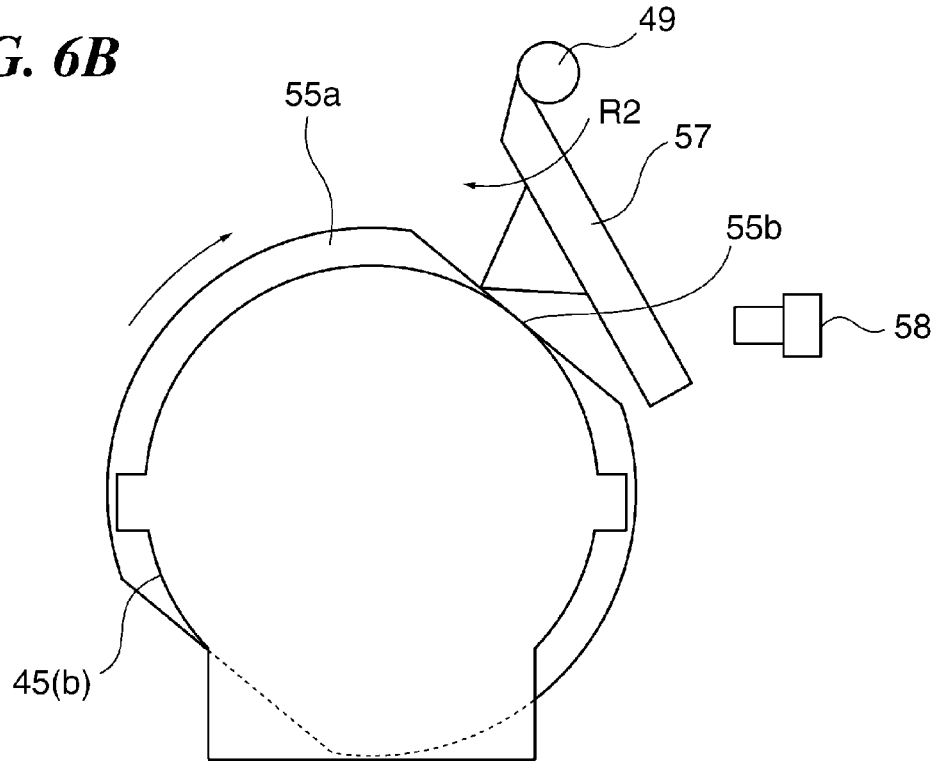
FIG. 6B is a view schematically showing the main part in a state where the rotation detection flag is in contact with a flat portion of the detected portion of the toner bottle as shown in FIG. 3B.

As shown in FIG. 6A and FIG. 6B, the rotation detection flag 57 and the rotation detection sensor 58 for detecting the rotation phase of the toner bottle 20*a* are arranged so as to face the detected portion 55 formed on the large diameter portion 45*b* of the drum section 45 of the toner bottle 20*a*. When the rotation detection flag 57 contacts with the convex part 55*a* that rotates with the drum section 45 during the rotation of the drum section 45 of the toner bottle 20*a*, the rotation detection flag 57 swings in an arrow R1 direction in FIG. 6A around a center of a rotating shaft 49. On the other hand, when the rotation detection flag 57 contacts with the flat part 55*b*, the rotation detection flag 57 swings in an arrow R2 direction in FIG. 6B.

The rotation detection sensor 58 is an optical sensor that has a light emitting section and a light sensing section. In a case where the rotation detection flag 57 exists between the light emitting section and the light sensing section (state in FIG. 6A), the received light amount of the light sensing section is below a threshold. In this case, the rotation detection sensor 58 outputs the "Hi" signal as a specified signal. On the other hand, in a case where the rotation detection flag 57 does not exist between the light emitting section and the light sensing section (state in FIG. 6B), the received light amount of the light sensing section becomes more than the threshold. In this case, the rotation detection sensor 58 outputs the "Low" signal as a signal other than the specified signal (non-specified signal).

That is, the output signal of the rotation detection sensor 58 varies from the "Low" signal that does not detect the rotation detection flag 57 to the "Hi" signal that detects the rotation detection flag 57, and varies from the "Hi" signal to the "Low" signal according to the rotation of the toner bottle 20*a*.

The detected portion 55 and the rotation detection flag 57 are arranged so that the rotation detection flag 57 contacts with the flat part 55*b* in the period during which the pump unit 50 contracts, i.e., the toner bottle 20*a* discharges the toner, and so that the toner discharging operation is completed in a case where the rotation detection flag 57 contacts with the end of the flat part 55*b*. Thus, the turning point at which the output of the rotation detection sensor 58 varies from the "Low" signal to the "Hi" signal corresponds to the termination point of the toner discharging operation. Hereinafter, the specific rotation information that represents the turning point at which the output of the rotation detection sensor 58 varies from the "Low" signal to the "Hi" signal, i.e., the turning point at which the non-specified signal varies to the specified signal, is referred to as a rising edge.

The pumping count of the pump unit 50 is obtained by counting the detection count of this specific rotation information (rising edge). The toner replenishing amount replenished to the development device 5*a* from the toner bottle 20*a* is presumed based on this pumping count and the rotational velocity of the toner bottle. That is, the CPU 70 stops the rotation of the toner bottle 20*a*, in a case where the specific number of the rising edges that correspond to the toner amount that should be replenished to the development device 5*a* are detected. It should be noted that the CPU 70 calculates the toner amount (required toner replenishing amount) that should be replenished to the development device 5*a* based on image information (a video count value) or the detection information from a toner density sensor arranged in the development device.

Returning to FIG. 5A, the CPU 70 determines whether n times of the rising edges that correspond to the necessary toner replenishing amount were detected from the rotation detection sensor 58 (step S13), after starting replenishing the toner to the development device 5*a* (step S12). That is, the CPU 70 determines whether the toner of the necessary toner replenishing amount has been replenished to the development device 5*a* from the toner bottle 20*a*. Next, the CPU 70 stops driving the drive motor 60 (step S15) at the timing of detecting n times of the rising edges from the rotation detection sensor 58 ("YES" in the step S13), and finishes this process.

In the step S15, the CPU 70 stops driving the drive motor 60 to stop the rotation of the toner bottle 20*a* without checking the output of the rotation detection sensor 58. In the state where there is no toner in the toner bottle 20*a*, it is necessary to stop the toner bottle at the home position (detecting state) in order to detect dismounting of the toner bottle 20*a* by the rotation detection sensor 58. On the other hand, in the state where there is toner in the toner bottle 20*a*, there is no problem even when the toner bottle 20*a* stops at a position (non-detecting state) other than the home position, because it is unnecessary to detect dismounting of the toner bottle. And if the toner bottle 20*a* is rotated until becoming the detecting state in such a case, satisfactorily and also in this case, the excessive toner will be replenished to the development device 5*a* from the toner bottle 20*a*. That is, in a case where there is toner in the toner bottle 20*a*, the CPU 70 stops the rotation of the toner bottle 20*a* in the step S15 without detecting a rising edge again, even if the output of the rotation detection sensor 58 has switched to the "Low" signal.

On the other hand, at step S13, when the rotation detection sensor 58 has not detected n times of the rising edges ("NO" in the step 13), the CPU 70 determines whether a predetermined time period (t11) elapsed after starting drive of the drive motor (step S14). As a result of the determination in the step S14, when the predetermined time period (t11) elapsed ("YES" in the step S14), the CPU 70 recognizes a toner-replenishment error (step S16). When the predetermined time period (t11) does not elapsed, the process returns to the step S13. The toner-replenishment error is caused by an anomaly of load torque, sensor failure, motor failure, etc. It should be noted that the predetermined time period t11 is set to be proportional to the number (n) of the rising edges that should be detected.

On other hand, as a result of the determination in the step S10, when it is determined that there is no toner in the toner bottle 20*a* ("NO" in the step S10), the CPU 70 executes the following process on the assumption of exchange of toner bottles. That is, the CPU 70 starts the PWM control of the drive motor 60 first in order to discharge the residual toner in the toner bottle 20*a*, sets the DUTY ratio to K2 that was define beforehand (step S21), and then starts driving the drive motor 60 (step S22). Second rotational velocity of the toner bottle 20*a* in a case where the DUTY ratio is K2 is higher than first rotational velocity of the toner bottle 20*a* in a case of the regular toner replenishment that does not need exchange of the toner bottles.

Next, the CPU 70 determines whether the rotation detection sensor 58 detected the prescribed number (5 times, in this embodiment) of rising edges (step S23). Then, the CPU 70 stops driving the drive motor 60 (step S25) in a case where the rising edges are detected 5 times ("YES" in the step S23).

On the other hand, as a result of the determination in the step S23, when the rotation detection sensor 58 has not detected 5 times of the rising edges ("NO" in the step S23), the CPU 70 determines whether a predetermined time period (t12) elapsed after starting the drive of the drive motor 60 (step S24). As a result of the determination in the step S24, when the predetermined time period (t12) elapsed after starting the drive of the drive motor 60 ("YES" in the step S24), the CPU 70 recognizes a toner discharge error (step S26). On the other hand, as a result of the determination in the step S24, when the predetermined time period (t12) has not elapsed ("NO" in the step S24), the CPU 70 returns the process to the step S23. The toner discharge error is caused by an anomaly of load torque, sensor failure, motor failure, etc. like the case of the regular toner replenishment operation.

After stopping the drive of the drive motor 60 (step S25) because the process for discharging the residual toner in the toner bottle completed, the CPU 70 checks whether the toner bottle 20*a* has stopped at the home position (step S27). Whether the toner bottle has stopped at the home position is checked by whether the rotation detection sensor 58 outputs the "Hi" signal. In the step S25, since the drive of the drive motor 60 is stopped at the timing when the rotation detection sensor 58 detects the rising edge, there is a high possibility that the toner bottle 20*a* has stopped at the home position. As a result of the check in the step S27, when the toner bottle 20*a* has stopped at the home position ("YES" in the step S27), the CPU 70 notifies a user by displaying a message to urge the user to exchange toner bottles on the UI 90 (step S34), and finishes this process.

On the other hand, as a result of the check in the step S27, when the toner bottle 20*a* has not stopped at the home position ("NO" in the step S27), the CPU 70 lowers the DUTY ratio in the PWM control of the drive motor 60, and resumes driving. That is, the CPU 70 sets the DUTY ratio in the PWM control of the drive motor 60 to 0.7 times of K2 that is the last DUTY ratio (step S28), and starts driving the drive motor 60 again (step S29). In order to stop the toner bottle 20*a* at the home position, it is effective to lower the rotational velocity.

Generally, since the toner bottles are exchanged in a case where there is no toner in the toner bottle 20*a* (in the container), load becomes small and the toner bottle rotates easily by inertia. Moreover, if the DUTY ratio of the PWM control of the drive motor 60 is increased to increase the rotational velocity of the toner bottle 20*a* in order to discharge the residual toner in the toner bottle 20*a* within a predetermined time period, the rotation amount of the toner bottle 20*a* by inertia (inertia rotation amount) will increase. In such a case, the toner bottle 20*a* may stop after passing the home position. Moreover, in a case where a cheap brush motor or the like is used as the drive motor 60 for driving the toner bottle 20*a*, the toner bottle 20*a* rotates by inertia and may stop after passing the home position.

Hereinafter, a rotational velocity adjustment for stopping the toner bottle 20*a* at the home position will be described.

Figure 7A:
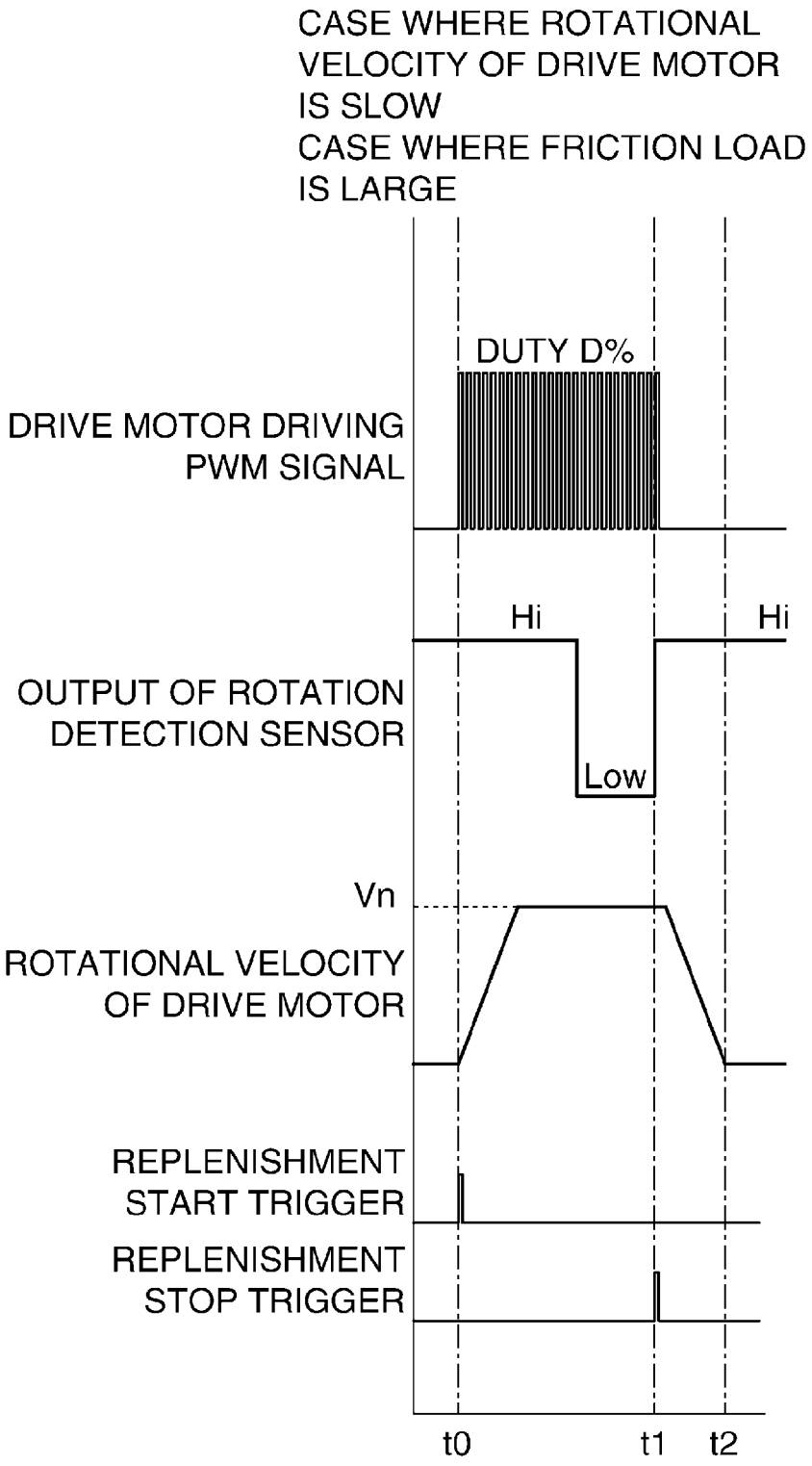
FIG. 7A and FIG. 7B are timing charts showing the toner-bottle stop process in the image forming apparatus in FIG. 1.
Figure 7B:
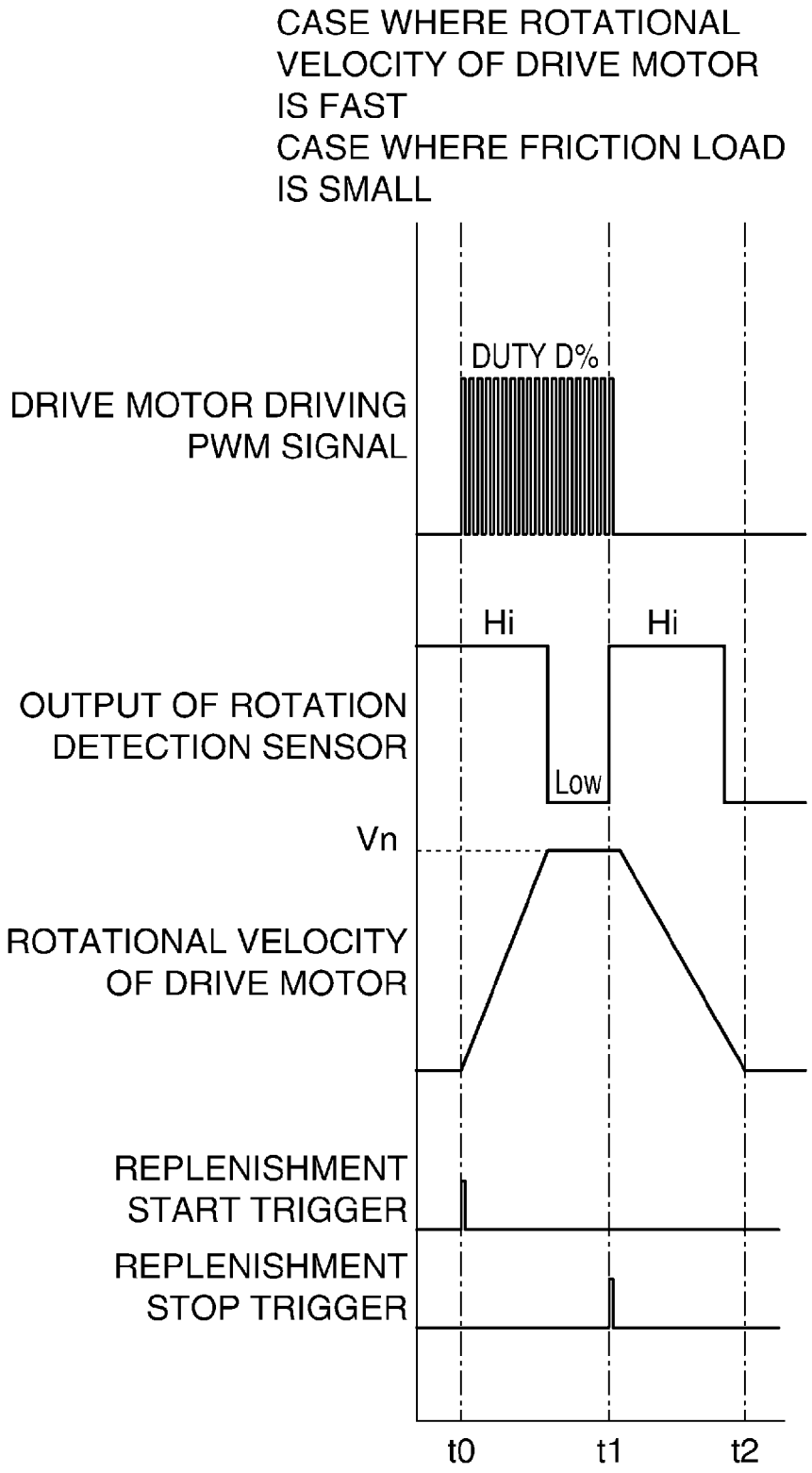

FIG. 7A and FIG. 7B are timing charts showing the toner-bottle stop process in the image forming apparatus in FIG. 1.

In a case where the rotational velocity of the drive motor is slow, and in a case where the friction load of the motor or the toner bottle is large, there is high tendency that the toner bottle stops within a time period during which the rotation detection sensor outputs the "Hi" signal as shown in FIG. 7A. In FIG. 7A, the rotation of the drive motor is started at a timing t0 by a toner replenishment start trigger, then, the rotational velocity of the drive motor is stabilized, and the output of the rotation detection sensor varies from the "Hi" signal to the "Low" signal, and varies from the "Low" signal to the "Hi" signal. With detection of the turning point where the output of the rotation detection sensor varies from the "Low" signal to the "Hi" signal, the drive of the drive motor is stopped by a toner replenishment stop trigger at a timing t1. Although the drive motor rotates by inertia in this time, the toner bottle 20*a* stops at the home position because of relatively small inertia rotation amount.

On the other hand, in a case where the rotational velocity of the drive motor is high and the friction load of the motor or the toner bottle is small, the toner bottle may stop at a position where the rotation detection sensor outputs the "Low" signal as shown in FIG. 7B. In FIG. 7B, the rotation of the drive motor is started at a timing t0 by a toner replenishment start trigger, then, the rotational velocity of the drive motor is stabilized, and the output of the rotation detection sensor varies from the "Hi" signal to the "Low" signal, and varies from the "Low" signal to the "Hi" signal. With detection of the turning point where the output of the rotation detection sensor varies from the "Low" signal to the "Hi" signal, the drive of the drive motor is stopped by a toner replenishment stop trigger at a timing t1. Since the drive motor rotates by inertia in this time, the toner bottle 20*a* cannot stop at the home position and stops in an area where the rotation detection sensor outputs the "Low" signal because of large inertia rotation amount.

As shown in FIG. 7A and FIG. 7B, the possibility that the toner bottle 20*a* stops at the home position becomes high as the rotational velocity of the drive motor 60 becomes slow.

Returning to FIG. 5B, after starting the drive of the drive motor 60 at the rotational velocity smaller than that in the process for discharging residual toner (step S29), the CPU 70 determines whether the rotation detection sensor 58 detected the rising edge (step S30). Next, the CPU 70 stops the PWM control of the drive motor 60 (step S31), when the rising edge is detected. Since this process aims to stop the toner bottle 20*a* at the home position, it is sufficient that the rising edge is detected once. Next, the CPU 70 returns the process to the step S27 in order to check whether the toner bottle 20*a* has stopped at the home position. Then, the CPU 70 repeats the process in the steps S28 through S31 until the toner bottle 20*a* stops at the home position.

On the other hand, as a result of the determination in the step S30, when the rotation detection sensor 58 has not detected the rising edge ("NO" in the step S30), the CPU 70 determines whether a predetermined time period (t13) elapsed after starting the drive of the drive motor 60 (step S32). As a result of the determination in the step S32, when the predetermined time period (t13) elapsed ("YES" in the step S32), the CPU 70 recognizes a stop position adjustment error (step S33). On the other hand, as a result of the determination in the step S32, when the predetermined time period (t13) has not elapsed ("NO" in the step S32), the CPU 70 returns the process to the step S30. The stop position adjustment error is caused by an anomaly of load torque, sensor failure, motor failure, etc. It should be noted that the DUTY ratio of the PWM control of the drive motor 60 in the step S28 is set to a value smaller (0.7 times) than the DUTY ratio in the step S21. Accordingly, the predetermined time period t13 used for recognizing the stop-position adjustment error is set to be longer than the predetermined time period t11 (value in n=1) used for recognizing the replenishment error.

According to the process in FIG. 5A and FIG. 5B, it is determined whether there is toner in the toner bottle 20*a* (the step S10). In a case where there is no toner, the rotational velocity of the drive motor 60 is increased (the step S21), and the residual toner is discharged (the step S22) as the assumption of exchange of toner bottles. This eliminates futility of toner and enables effective use of toner. Moreover, the drive of the drive motor 60 is stopped (the step S25) after discharging the residual toner by rotating the toner bottle 20*a* for a prescribed number of times, it is determined whether the drive of the drive motor 60 has stopped (the step S27). Then, in a case where the toner bottle 20*a* has not stopped at the home position, the process (the steps S28 through S31) for decreasing the rotational velocity in order to stop the toner bottle at the home position is executed. As a result of this, there is high possibility that the toner bottle 20*a* stops at the home position because the rotation amount due to inertia is reduced. Accordingly, the CPU 70 correctly detects that the user dismounts the toner bottle 20*a* from the image forming apparatus 200 and that the user mounts a new toner bottle 20*a* by monitoring the output of the rotation detection sensor 58 after that.

Figure 8A:
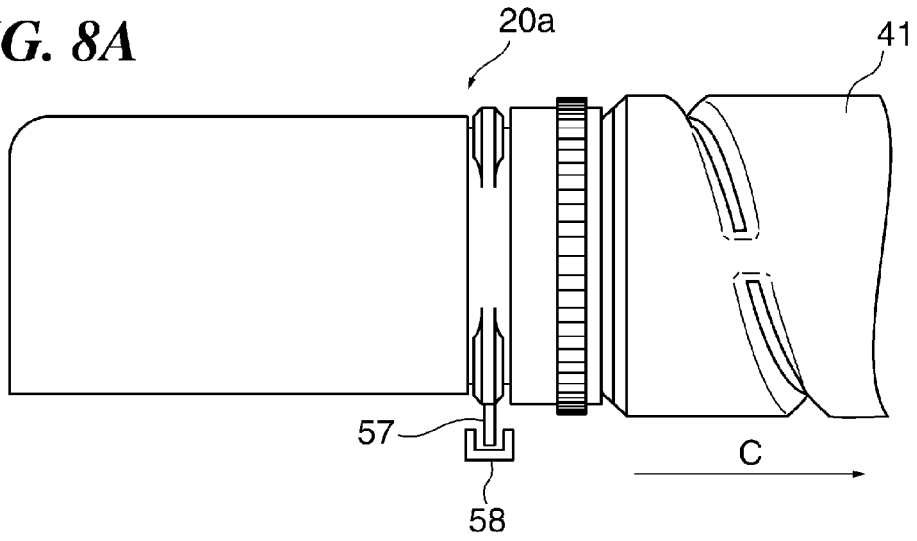
FIG. 8A, FIG. 8B, and FIG. 8C are views schematically showing positional relationships between the toner bottle and the rotation detection sensor at different timings while pulling out the toner bottle from the image forming apparatus in FIG. 1.
Figure 8B:
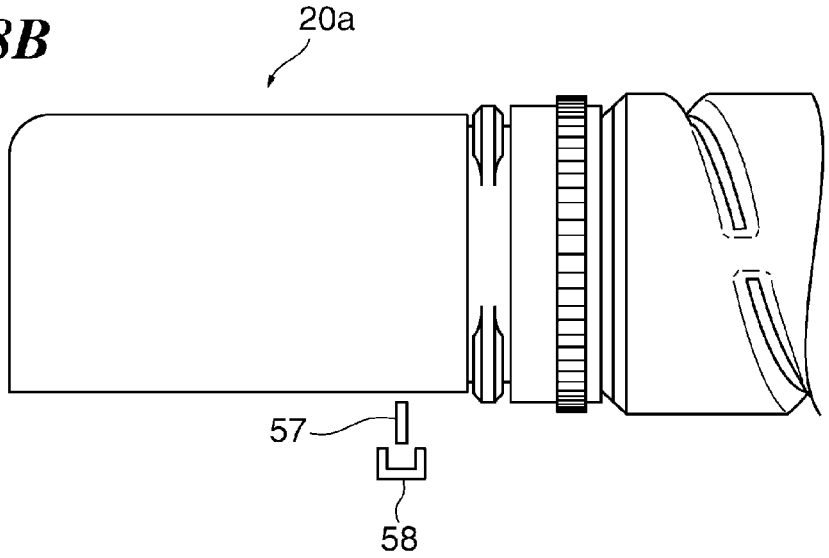
Figure 8C:
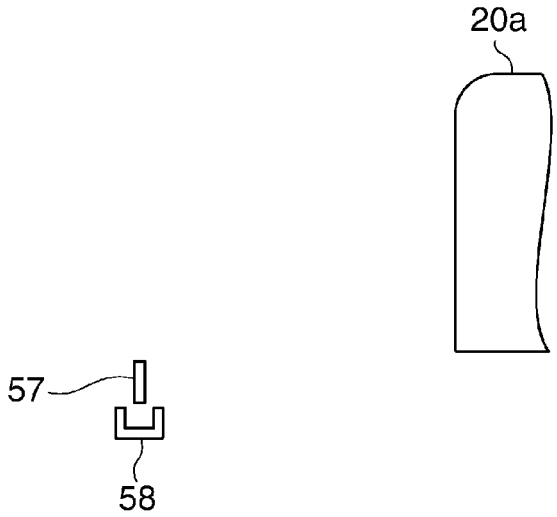

FIG. 8A, FIG. 8B, and FIG. 8C are views schematically showing positional relationships between the toner bottle 20 and the rotation detection sensor at different timings while pulling out the toner bottle 20 from the image forming apparatus 200.

At the home position, the rotation detection flag 57 is detected by the rotation detection sensor 58 as shown in FIG. 8A. In a case where the toner bottle 20*b* is moved in a direction of an arrow C in FIG. 8A, the rotation detection flag 57 is dismounted from the rotation detection sensor 58 as shown in FIG. 8B. Since the light sensing section of the rotation detection sensor 58 receives the light amount more than the threshold at this time, the rotation detection sensor 58 outputs the "Low" signal. In a case where the toner bottle 20*a* is further moved in the arrow C direction from the state where the rotation detection sensor 58 outputs the "Low" signal shown in FIG. 8B, the toner bottle 20*a* is dismounted from the image forming apparatus 200 while keeping the "Low" signal (FIG. 8C).

Moreover, in a case where a new toner bottle is mounted after dismounting the old toner bottle 20*a*, and in a case where the new toner bottle is set at the home position where the rotation detection sensor 58 detects the rotation detection flag 57 (FIG. 8A) and outputs the "Hi" signal, the CPU 70 is able to detect the mounting of the toner bottle. On the other hand, in a case where the mounted toner bottle is not set at the home position, a process similar to the process in the steps S27 through S33 is executed at a predetermined timing so that the toner bottle is set at the home position. Namely, when the toner bottle is set at the home position before dismounting and after mounting, the CPU 70 detects that the user dismounts the toner bottle 20*a* from the image forming apparatus 200 and that the user mounts a new toner bottle 20*a* by monitoring the output of the rotation detection sensor 58. It should be noted that the above-mentioned specified timing is a timing at which a door of the image forming apparatus is opened and closed when exchanging toner bottles, for example.

In this case, the rotation detection sensor 58 that detects the rotation phase of the toner bottle 20*a* functions as a container determination unit that detects exchange of toner bottles. That is, since the dismounting of the toner bottle is detected using the rotation detection sensor 58 that detects the rotation phase of a container, the exchange of toner bottles is detected without adding a dedicated detection means.

According to this embodiment, the CPU 70 displays a message to urge a user to exchange toner bottles, and then, the message is automatically removed in response to mounting the toner bottle 20*a*. That is, since a user does not required a complicated operation of inputting the exchange of toner bottles after exchanging toner bottles, usability is improved.

Furthermore, since the CPU 70 detects exchange of toner bottles automatically, an image forming operation starts promptly after exchanging toner bottles.

It should be noted that the DUTY ratio (K2) in the PWM control of the drive motor 60 for discharging the residual toner in the toner bottle 20*a* is larger than the DUTY ratio (K1) that is set in the step S11 for the regular toner replenishment. That is, the rotational velocity of the drive motor 60 for discharging the residual toner is set up to become higher than the rotational velocity for the regular toner replenishment. This is because the high rotational velocity of the toner bottle 20*a* facilitates the discharging of the residual toner and shortens the time required to discharge the residual toner.

Next, a second embodiment of the present invention will be described with reference to FIG. 9A and FIG. 9B.

In the first embodiment, in a case where the toner bottle 20*a* has not stopped at the home position after discharging the residual toner in the toner bottle 20*a* and stopping the drive motor 60, the drive motor 60 is driven and stopped again while making the DUTY ratio of the PWM control of the drive motor 60 smaller. On the other hand, in the second embodiment, the rotational velocity of the toner bottle 20*a* is reduced by making the DUTY ratio of the PWM control smaller after discharging the residual toner without stopping the drive motor. As a result, the drive motor 60 is controlled so that the toner bottle 20*a* stops at the home position.

Figure 9A:
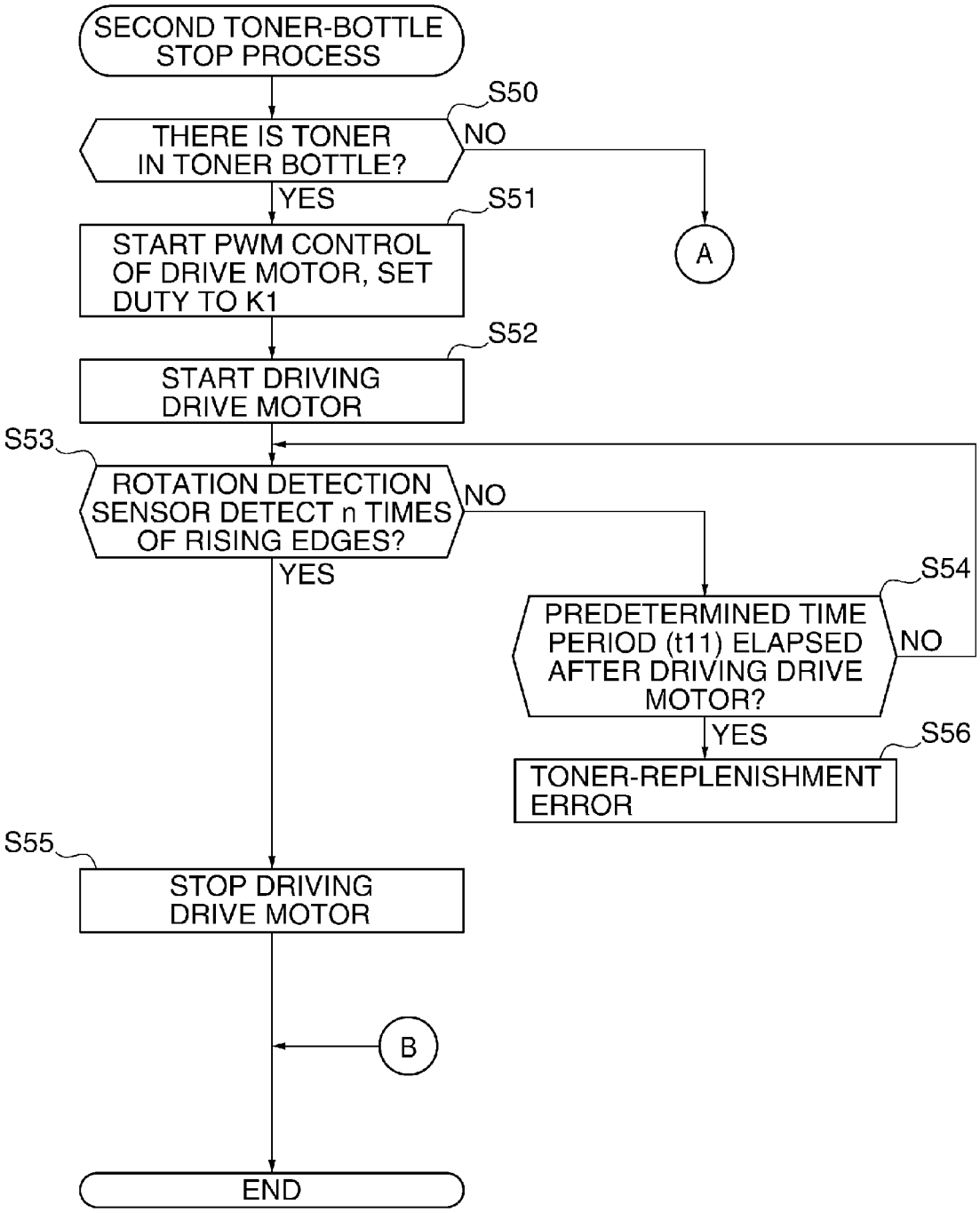
FIG. 9A and FIG. 9B are flowcharts showing a toner-bottle stop process according to a second embodiment of the present invention.
Figure 9B:
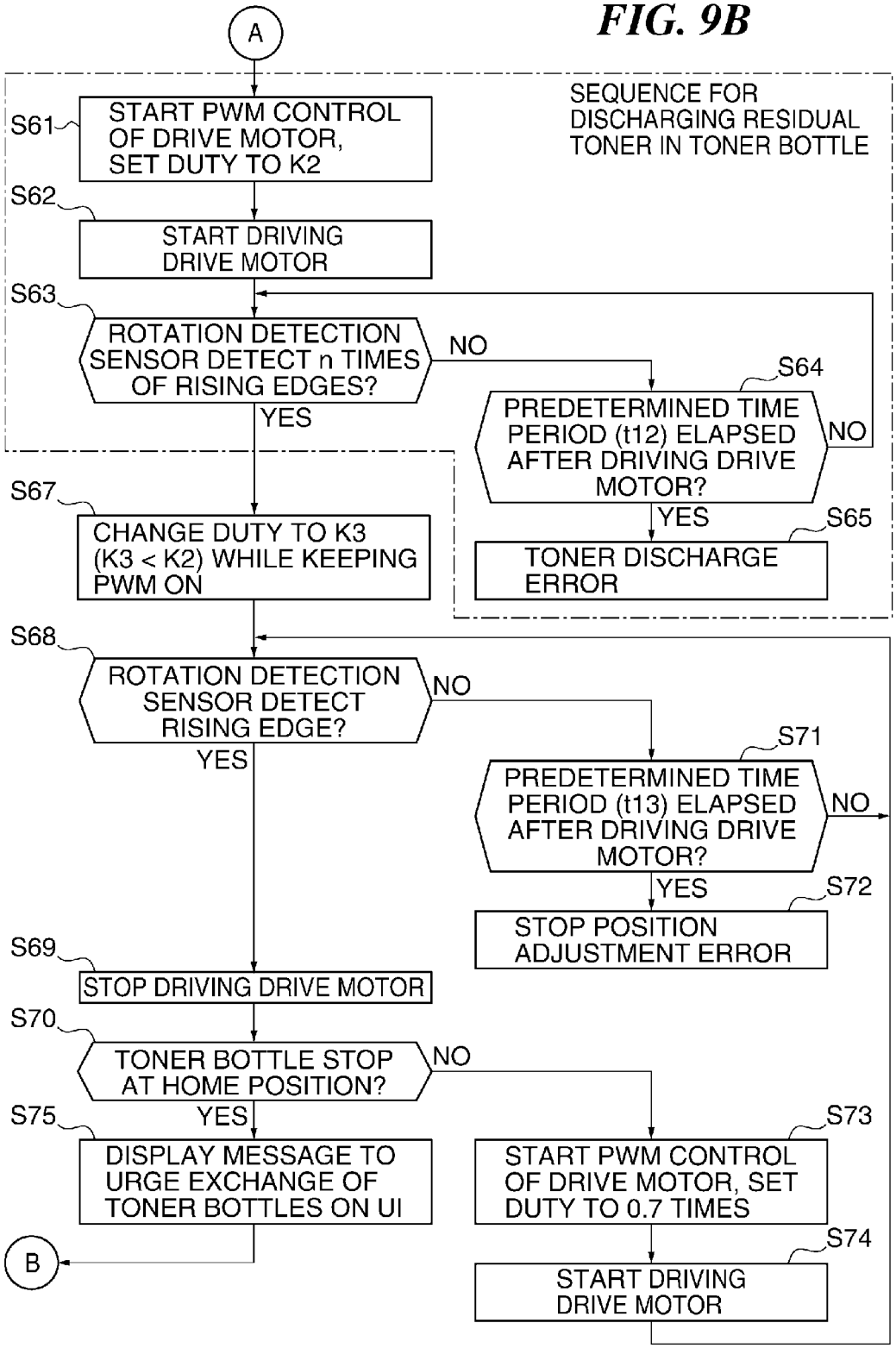

FIG. 9A and FIG. 9B are flowcharts showing the toner-bottle stop process according to the second embodiment. This toner-bottle stop process is executed by the CPU 70 that is arranged on the control base of the image forming apparatus according to a second toner-bottle stop process program stored in a ROM (not shown). The image forming apparatus in the second embodiment has a similar configuration to the image forming apparatus in the first embodiment.

Since the regular toner replenishment process in steps S50 through S56 in FIG. 9A is the same as the process in the steps S10 through S16 in the first embodiment, its description is omitted.

As a result of the determination in the step S50, when it is determined that there is no toner in the toner bottle 20*a* ("NO" in the step S50), the CPU 70 executes the following process on the assumption of exchange of toner bottles. That is, the CPU 70 starts the PWM control of the drive motor 60 first in order to discharge the residual toner in the toner bottle 20*a*, sets the DUTY ratio to K2 that was define beforehand (step S61), and then starts driving the drive motor 60 (step S62). Second rotational velocity of the toner bottle 20*a* in a case where the DUTY ratio is K2 is higher than first rotational velocity of the toner bottle 20*a* in a case of the regular toner replenishment that does not need exchange of toner bottles.

Next, the CPU 70 determines whether the rotation detection sensor 58 detected the prescribed number (5 times, in this embodiment) of rising edges (step S63). When detecting 5 times of rising edges ("YES" in the step S63), the CPU 70 switches the DUTY ratio of the PWM control without stopping the drive motor 60. That is, the CPU 70 changes the DUTY ratio of the PWM control to K3 that is smaller than K2 in order to make the rotational velocity of the toner bottle 20*a* slower (step S67).

On the other hand, as a result of the determination in the step S63, when the rotation detection sensor 58 has not detected 5 times of the rising edges ("NO" in the step S63), the CPU 70 determines whether a predetermined time period (t12) elapsed after starting the drive of the drive motor 60 (step S64). As a result of the determination in the step S64, when the predetermined time period (t12) elapsed after starting the drive of the drive motor 60 ("YES" in the step S64), the CPU 70 recognizes a toner discharge error (step S65). On the other hand, as a result of the determination in the step S64, when the predetermined time period (t12) has not elapsed ("NO" in the step S64), the CPU 70 returns the process to the step S63. The toner discharge error is caused by an anomaly of load torque, sensor failure, motor failure, etc. like the case of the regular toner replenishment operation.

Next, after changing the rotational velocity of the toner bottle 20*a* to slower velocity (step S67), the CPU 70 determines whether the rotation detection sensor 58 detected the rising edge (step S68). Since this process aims to stop the toner bottle 20*a* at the home position, it is sufficient that the rising edge is detected once. As a result of the determination in the step S68, when the rotation detection sensor 58 detected the rising edge ("YES" in the step S68), the CPU 70 stops driving the drive motor 60 (step S69). Next, the CPU 70 checks whether the toner bottle 20*a* has stopped at the home position (step S70). As a result of the check in the step S27, when the toner bottle 20*a* has stopped at the home position ("YES" in the step S70), the CPU 70 notifies a user by displaying a message to urge the user to exchange toner bottles on the UI 90 (step S75), and finishes this process.

On the other hand, as a result of the determination in the step S68, when the rotation detection sensor 58 has not detected the rising edge ("NO" in the step S68), the CPU 70 determines whether a predetermined time period (t13) elapsed after making the DUTY ratio of the drive motor 60 smaller (step S71). As a result of the determination in the step S71, when the predetermined time period (t13) elapsed ("YES" in the step S71), the CPU 70 recognizes a stop position adjustment error (step S72). On the other hand, as a result of the determination in the step S71, when the predetermined time period (t13) has not elapsed ("NO" in the step S71), the CPU 70 returns the process to the step S68.

Moreover, as a result of the determination in the step S70, when the toner bottle 20*a* has not stopped at the home position ("NO" in the step S70), the CPU 70 sets the DUTY ratio of the PWM control of the drive motor 60 to 0.7 times, for example, of K3 that is set in the step S67 (step S73), restarts driving the drive motor 60 (step S74), and then, returns the process to the step S68. Hereafter, the same process is repeated and the toner bottle 20*a* is stopped at the home position.

According to the process in FIG. 9A and FIG. 9B, the drive motor 60 is controlled so as to decrease the rotational velocity of the toner bottle 20*a* during rotation without stopping rotation of the drive motor 60 before a user is required to exchange toner bottles. As a result of this, the toner bottle 20*a* easily stops at the home position because the revolution amount due to inertia is reduced. Moreover, in a case where a user dismounts the toner bottle 20*a* from the image forming apparatus 200 in order to exchange toner bottles after stopping the toner bottle 20*a* at the home position, the dismounting is detectable with the rotation detection sensor 58 as with the first embodiment. Moreover, in a case where a new toner bottle is mounted, the mounting is detectable with the rotation detection sensor 58 as with the first embodiment. Accordingly, the CPU 70 detects the rotation phase of the toner bottle 20*a* based on the output of the rotation detection sensor 58, and also detects mounting/dismounting of the toner bottle 20*a*.

In the second embodiment, in a case where the toner bottle 20*a* has not stopped at the home position even when the toner bottle 20 is rotated at the rotational velocity that is slower than that at the time of discharging the residual toner and is stopped, the CPU 70 makes the DUTY ratio of the PWM control of the drive motor 60 further smaller, and starts and stops driving. As a result of this, the toner bottle 20*a* easily stops at the home position.

Moreover, in the second embodiment, the drive of the drive motor 60 is started and stopped again after making the DUTY ratio of the PWM control of the drive motor 60 further smaller. Instead of this, it is possible to make the DUTY ratio K3 set in the step S67 small enough compared with the DUTY ratio K2 set in the step S61. It such a case, the toner bottle 20*a* easily stops at the home position, and also the process in the steps S73 and S74 is omitted.

According to this embodiment, the CPU 70 displays a message to urge a user to exchange toner bottles, and then, the message is automatically removed in response to the mounting of the toner bottle 20*a*. That is, since a user does not required a complicated operation of inputting the exchange of toner bottles after exchanging toner bottles, usability is improved.

Furthermore, since the CPU 70 detects exchange of toner bottles automatically, an image forming operation starts promptly after exchanging toner bottles.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-184639, filed Sep. 6, 2013, which is hereby incorporated by reference herein in its entirety.

What is claimed is:

1. An image forming apparatus comprising:

a development unit configured to develop an electrostatic latent image formed on a photosensitive member using toner;

a mounting portion configured to which a container is mountable, the container containing toner;

a drive unit configured to rotate the container mounted to the mounting portion for replenishing the toner in the container to the development unit;

an output unit configured to detect a predetermined portion of the container in a rotation direction of the container that is rotated by the drive unit, to output a first signal while the predetermined portion is detected, and to output a second signal while the predetermined portion is not detected;

a decision unit configured to decide a toner replenishing amount that should be replenished to the development unit, and to decide a count of changes of the output of the output unit from the second signal to the first signal while the drive unit rotates the mounted container based on the decided replenishing amount;

a controller configured to control the drive unit based on the count decided by the decision unit;

a determination unit configured to determine whether the container mounted to the mounting portion should be exchanged with a new container; and a detection unit configured to detect that the container mounted to the mounting portion is dismounted in a case where the output of the output unit changes from the first signal to the second signal in a period during which the mounted container is not rotating, wherein the controller is configured to control the drive unit to stop the rotation of the container in a case where the count of changes of the output of the output unit from the second signal to the first signal reaches the count decided by the decision unit, wherein the controller controls, in a case where the determination unit determines that the mounted container should be exchanged with a new container, the drive unit so that the output unit outputs the first signal when the output unit outputs the second signal at the time of stopping the rotation of the container by the drive unit, and wherein the controller does not control, in a case where the determination unit does not determine that the mounted container should be exchanged with a new container, the drive unit so that the output unit outputs the first signal even when the output unit outputs the second signal at the time of stopping the rotation of the container by the drive unit.

2. The image forming apparatus according to claim 1, wherein the controller controls the drive unit so as to stop rotation of the container after rotating the container at rotational velocity that is slower than rotational velocity before stopping the rotation of the container in a case where the determination unit determines that the mounted container should be exchanged with a new container, and in a case where the output unit outputs the second signal at the time of stopping the rotation of the container by the drive unit.

3. The image forming apparatus according to claim 1, wherein the development unit contains developer that includes toner, and has a measuring unit for measuring toner density of the developer in the development unit, and wherein the decision unit decides the replenishing amount based on the toner density measured with the measuring unit.

4. The image forming apparatus according to claim 1, wherein the decision unit decides the replenishing amount based on image data transmitted to the image forming apparatus.

5. The image forming apparatus according to claim 1, wherein the development unit contains developer that includes toner, and has a measuring unit for measuring toner density of the developer in the development unit, and wherein the determination unit determines that the container mounted to the mounting portion should be exchanged with a new container, in a case where the toner density measured with the measuring unit under a state where the drive unit rotates the mounted container does not increase.

6. The image forming apparatus according to claim 1, wherein the development unit contains developer that includes toner, and has a measuring unit for measuring toner density of the developer in the development unit, and further comprising a notification unit configured to notify a user that the container mounted to the mounting portion should be exchanged with a new container, in a case where the toner density measured with the measuring unit under a state where the drive unit rotates the mounted container does not increase.

7. The image forming apparatus according to claim 1, wherein the development unit contains developer that includes toner, and has a measuring unit for measuring toner density of the developer in the development unit, and wherein the controller makes the drive unit rotate the container by a specified rotation amount, in a case where the toner density measured with the measuring unit does not increase in a case where the count of changes of the output of the output unit from the second signal to the first signal reaches the count decided by the decision unit.

8. The image forming apparatus according to claim 7, wherein the rotational velocity of the container that is rotated with the drive unit by the specified rotation amount is faster than the rotational velocity of the container that is rotated with the drive unit based on the count decided by the decision unit.

9. The image forming apparatus according to claim 6, wherein the notification unit is provided with a display unit that displays a message to urge a user to exchange the container mounted to the mounting portion with a new container.

10. The image forming apparatus according to claim 9, wherein the notification unit displays the message, in a case where the rotation of the mounted container stops and the output unit outputs the first signal.

11. The image forming apparatus according to claim 10, wherein the notification unit removes the message in a case where the container is mounted to the mounting portion after displaying the message.

12. The image forming apparatus according to claim 1, further comprising:

a notification unit configured to notify a user of failure of the image forming apparatus, in a case where the count of changes of the output of the output unit from the second signal to the first signal does not reach the count decided by the decision unit even when a predetermined time period elapses after the drive unit started rotating the container.

13. The image forming apparatus according to claim 1, wherein the container is provided with a plurality of predetermined portions that are formed on different positions in the rotation direction of the container that is rotated with the drive unit.

14. The image forming apparatus according to claim 1, wherein the container is provided with a chamber that contains toner and a pump that changes internal pressure of the chamber, and wherein the toner is replenished from the chamber to the development unit because the pump expands and contracts in a case where the drive unit rotates the container mounted to the mounting portion.

15. The image forming apparatus according to claim 14, wherein the pump does not expand while the output unit is outputting the first signal.

16. The image forming apparatus according to claim 1, further comprising a door that is opened and closed in order to mount the container to the mounting portion, and wherein the controller makes the drive unit rotate the mounted container, in a case where the door is closed.

17. The image forming apparatus according to claim 1, wherein the controller changes the rotational velocity of the container that is mounted to the mounting portion and is rotated with the drive unit, in a case where the determination unit determines that the mounted container should be exchanged with a new container, and in a case where the output unit outputs the second signal at the time of stopping the rotation of the container with the drive unit, and wherein the rotational velocity changed is slower than the rotational velocity of the container that is mounted to the mounting portion and is rotated with the drive unit based on the count decided by the decision unit.

* * * * *